US008342914B2

(12) United States Patent
Thysell

(10) Patent No.: US 8,342,914 B2
(45) Date of Patent: Jan. 1, 2013

(54) MOBILE MACHINE FOR SCREEDING FLOOR SURFACES AND THE LIKE

(75) Inventor: Hakan Thysell, Soderkoping (SE)

(73) Assignee: HTC Sweden AB, Soderkoping (SE)

( * ) Notice: Subject to any disclaimer, the term of this patent is extended or adjusted under 35 U.S.C. 154(b) by 537 days.

(21) Appl. No.: 12/539,889

(22) Filed: Aug. 12, 2009

(65) Prior Publication Data

US 2010/0067984 A1 Mar. 18, 2010

Related U.S. Application Data

(63) Continuation-in-part of application No. 12/275,019, filed on Nov. 20, 2008, now abandoned, which is a continuation of application No. 11/141,195, filed on Jun. 1, 2005, now abandoned.

(51) Int. Cl.
*B24B 23/00* (2006.01)

(52) U.S. Cl. ..... 451/353; 451/357

(58) Field of Classification Search ..... 451/350, 451/353, 357

See application file for complete search history.

(56) References Cited

U.S. PATENT DOCUMENTS

| | | | | |
|---|---|---|---|---|
| 1,928,390 | A * | 9/1933 | Myers | 451/353 |
| 4,094,034 | A * | 6/1978 | Wilkins et al. | 15/49.1 |
| 4,122,576 | A * | 10/1978 | Bevington et al. | 15/49.1 |
| 4,622,782 | A | 11/1986 | Roestenberg | |
| 5,637,032 | A * | 6/1997 | Thysell et al. | 451/259 |
| 6,331,138 | B1 | 12/2001 | Witters et al. | |
| 6,616,517 | B2 * | 9/2003 | Palushi | 451/350 |
| 6,752,707 | B1 | 6/2004 | Palushi | |
| 7,140,957 | B2 | 11/2006 | Thysell et al. | |
| 2004/0023608 | A1 | 2/2004 | Van Vliet et al. | |
| 2004/0077300 | A1 * | 4/2004 | Thysell et al. | 451/350 |
| 2006/0276283 | A1 * | 12/2006 | Thysell | 474/85 |

FOREIGN PATENT DOCUMENTS

WO 02/062524 A1 8/2002

* cited by examiner

*Primary Examiner* — Maurina Rachuba
(74) *Attorney, Agent, or Firm* — Oblon, Spivak, McClelland, Maier & Neustadt, L.L.P.

(57) ABSTRACT

A mobile machine for screeding floor surfaces and the like comprises a planet disk, which is rotatably supported and driven by a drive motor, and which carries at least one screeding disk, operatively connected to the drive motor and defining one screeding plane. The operative connection comprises at least one belt or chain running over a belt sheave connected to the screeding disk, and a belt sheave connected to the drive motor. The belt sheave of the screeding disk has a central stub axle forming part of an automotive wheel hub, comprising wheel bolts attached to said planet disk.

16 Claims, 5 Drawing Sheets

MOBILE MACHINE FOR SCREEDING FLOOR SURFACES AND THE LIKE

CROSS REFERENCE TO RELATED APPLICATIONS

This application is a continuation-in-part of and is based upon and claims the benefit of priority under 35 U.S.C. §120 for U.S. Ser. No. 12/275,019, filed Nov. 20, 2008, which is a Continuation of U.S. Ser. No. 11/141,195, filed Jun. 1, 2005, the entire contents of each which are incorporated herein by reference.

FIELD OF THE INVENTION

The present invention relates to a mobile machine for screeding floor surfaces and the like.

BACKGROUND ART

A machine of that type is previously known from the applicant's PCT-application WO02/062524, which is hereby incorporated by reference.

Yet another such machine is known from U.S. Pat. No. 5,637,032. That machine comprises a planet disk, which is rotatably supported and driven by a drive motor, and which carries at least one screeding disk, that is operatively connected to the drive motor and defines a screeding plane. A belt is arranged to run over a belt sheave connected to the screeding disk and over a belt connected to the drive motor. A rotatable connection between the belt sheave of the screeding disk and the planet disk is provided by respective bearings, which are attached to an upper and lower plate forming the planet disk, respectively. An axle runs through the plates, extending below the lower plate for connection with the screeding disk and extending above the upper plate to provide another belt sheave.

A screeding machine of the aforementioned type uses several screeding disks which are mounted on specially designed holders comprising roller bearings. Due to heavy loads and vibrations while screeding and due to the dust produced thereby, the holders tend to deteriorate quite rapidly and thus have to be replaced rather frequently. For a user this causes costs both for repair works and for interrupted screeding as well as for spare parts, which are expensive primarily due to low production series.

OBJECT OF THE INVENTION

It is obvious that the user situation described is not ideal and that there is need of an improvement.

Thus, the object of the present invention is to introduce a mobile machine for screeding floor surfaces and the like, comprising holders which are extremely robust and yet cheaper to replace than the known ones once they are worn out.

SUMMARY OF THE INVENTION

According to the invention this is achieved by means of a mobile machine for screeding floor surfaces and the like, said machine comprising a planet disk, which is rotatably supported and driven by a drive motor, and which carries at least one screeding disk, operatively connected to the drive motor and defining one screeding plane, the operative connection comprising at least one belt or chain running over a belt sheave connected to the screeding disk, and a belt sheave connected to the drive motor, the belt sheave of the screeding disk having a central stub axle forming part of an automotive wheel hub, comprising wheel bolts attached to said planet disk.

Using automotive wheel hubs means use of a new type of holder produced in great numbers at a relatively low cost and made for withstanding great loads as well as tough environmental circumstances. This makes them particularly suited for screeding actions, where heavy loads, vibrations and dust are eminent, and solves all the problems with the prior art devices mentioned hereinbefore.

According to a currently preferred embodiment of invention the belt sheave of the screeding disk has a hub part, said stub axle extending through a central hole in said hub part and being secured to said hub part by a fastening device. This way rotational movement of the belt sheave is transferred to the stub axle in a secure way.

According to a currently preferred embodiment of invention, the belt sheave of the screeding disk has a hub part, said stub axle being furnished with a section of threads for fastening it to said hub part. An advantage of this embodiment is that the hub part may be screwed onto the stub axle and/or a fastening device may be screwed onto the stub axle, which is an efficient way of fastening and allows for simple assembling.

According to a currently preferred embodiment of invention the belt sheave of the screeding disk has a hub part, said hub part abutting a rotatable runner of the wheel hub on a side opposite to the side of the wheel hub facing the planet disk, said stub axle being a bolt extending through a central hole in said hub part and through said runner and fixing the belt sheave onto said runner by means of a nut. The advantage of this embodiment is that it is easy to assemble and that the bolt shaped stub axle is reuseable because it is not an integral part of the wheel hub.

Furthermore, the belt sheave of the screeding disk preferably are cup shaped protectively surrounding the wheel hubs. The advantage of this embodiment is that it provides extra protection for the wheel hubs against dust and that it reduces the height of the belt sheave/wheel hub combination to a minimum.

The belt or chain may also run over least one deflection sheave. This facilitates providing the correct tension of the belt or chain since the deflection sheave can be made adjustable.

The mobile machine may comprises a number of screeding disks, each being operatively connected to the drive motor. Hence, mobile machines having large capacity may be provided.

According to a second aspect, there is provided a mobile machine for screeding floor surfaces, which comprises a planet disk, which is rotatably supported and driven by a drive motor, and which carries at least one screeding disk, operatively connected to the drive motor and defining one screeding plane. The operative connection comprises at least one belt or chain running over a belt sheave connected to the screeding disk, and a belt sheave connected to the drive motor. A rotatable connection between the belt sheave of the screeding disk and the planet disk is provided by an automotive wheel hub, comprising a central sleeve, which connected to a central stub axle, and which by wheel bolts engaging a flange of the central sleeve is connected to the belt sheave of the screeding disk.

The flange may be arranged at a rim portion of the central sleeve.

An outer sleeve may be fixedly connected to the planet disk, and connected to the central sleeve by at least one roller bearing.

An adapter ring may be arranged to connect the outer sleeve to the planet disk

The central sleeve may be fixedly connected to the stub axle in at least a rotational direction.

BRIEF DESCRIPTION OF THE DRAWINGS

A preferred embodiment of the invention will be explained in more detail below with reference to the drawings attached, in which FIG. 1, in an oblique, perspective view from beneath, shows a screeding unit of a known screeding machine, having a drive motor and a dished planet disk, which accommodates a belt transmission.

DESCRIPTION OF THE PREFERRED EMBODIMENT

Figure 1A:
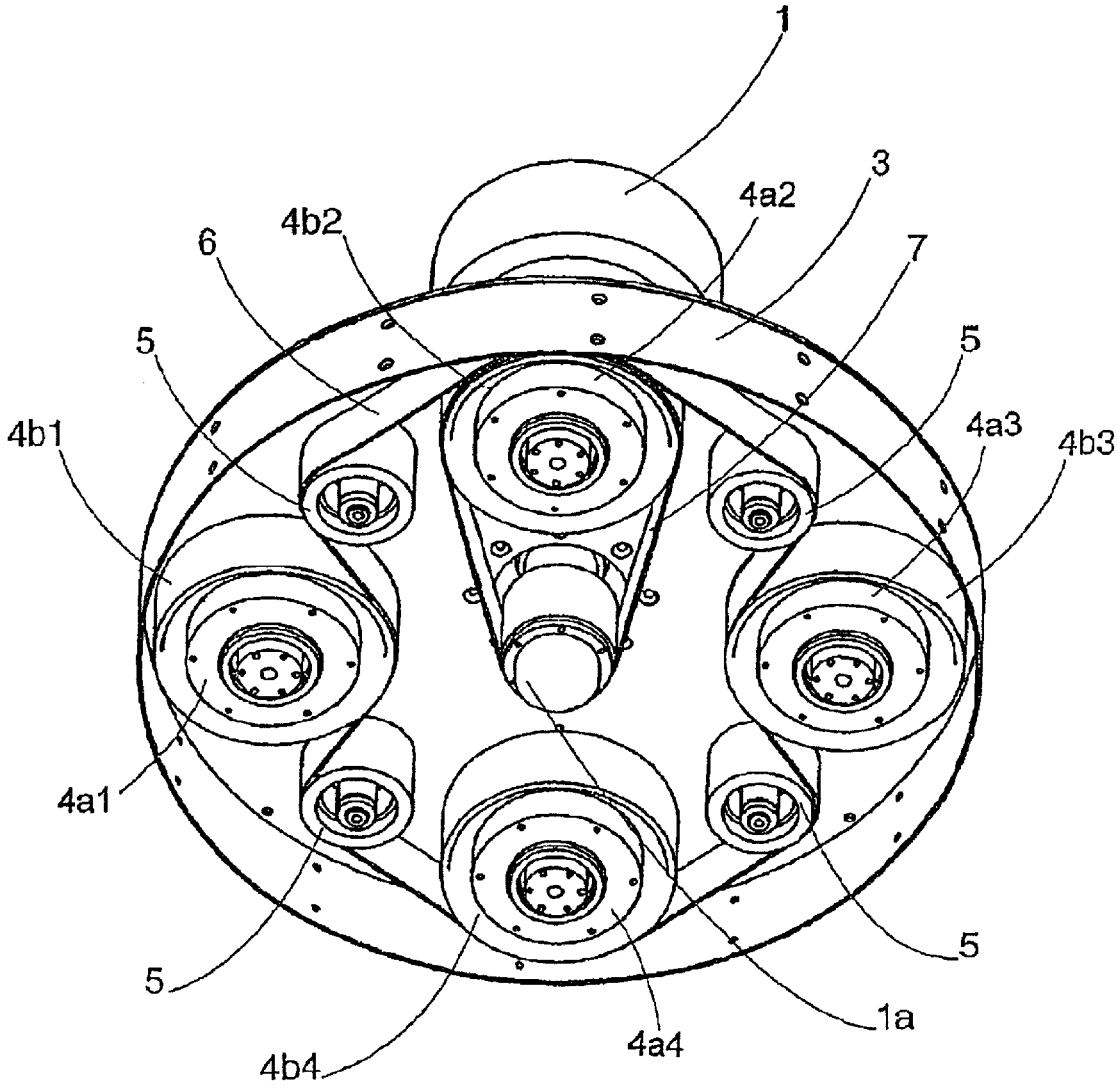
FIG. 1*b* shows the drive motor and the planet disk in FIG. 1*a* in an oblique perspective view from above.
FIG. 1*c* shows essentially the same view as FIG. 1*a*, but the planet disk and the belt transmission are covered by a cover plate with openings for the machine's screeding disks, and FIG. 2, in a vertical sectional view, shows a wheel hub forming part of the preferred embodiment of a screeding machine according to the invention.
Figure 1B:
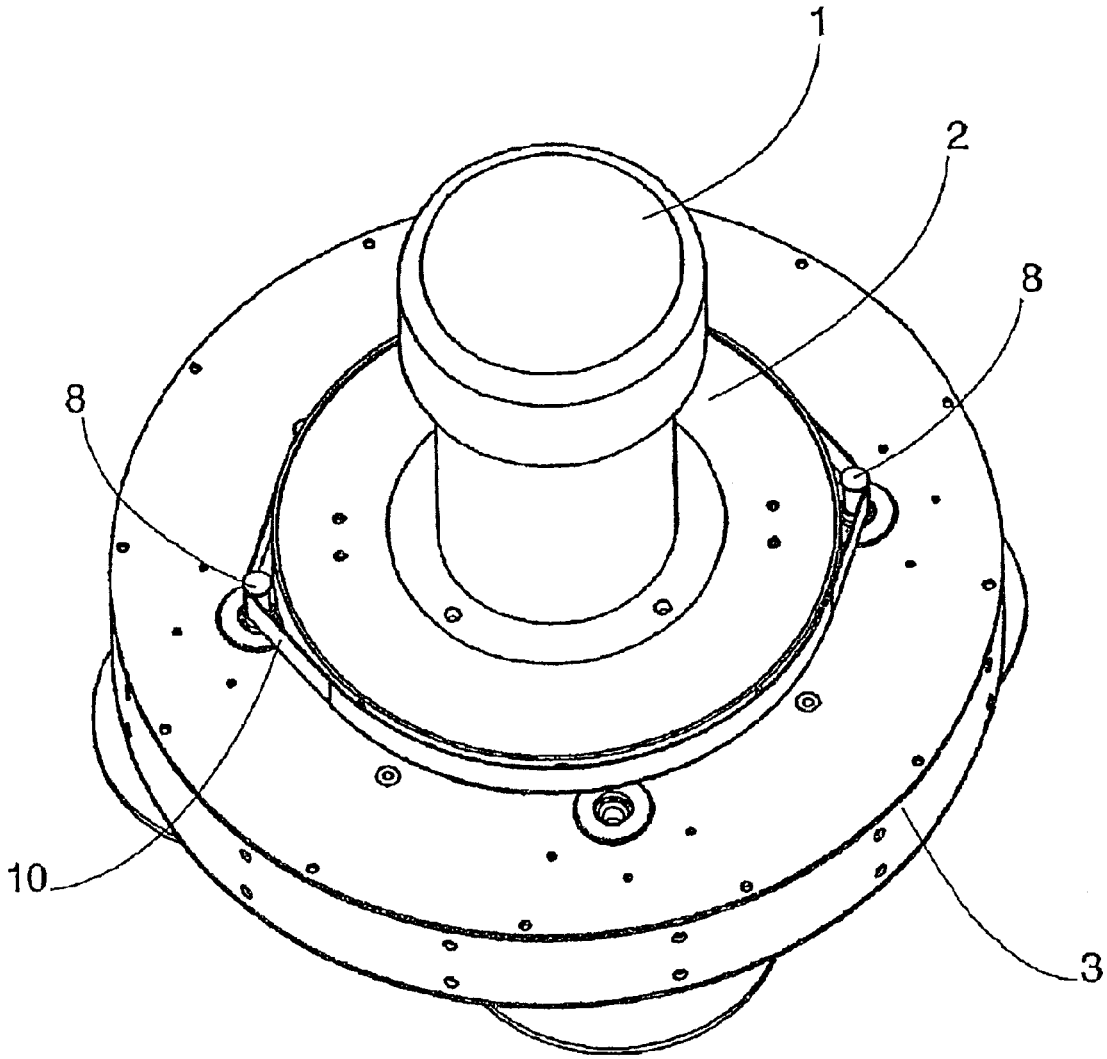
Figure 1C:
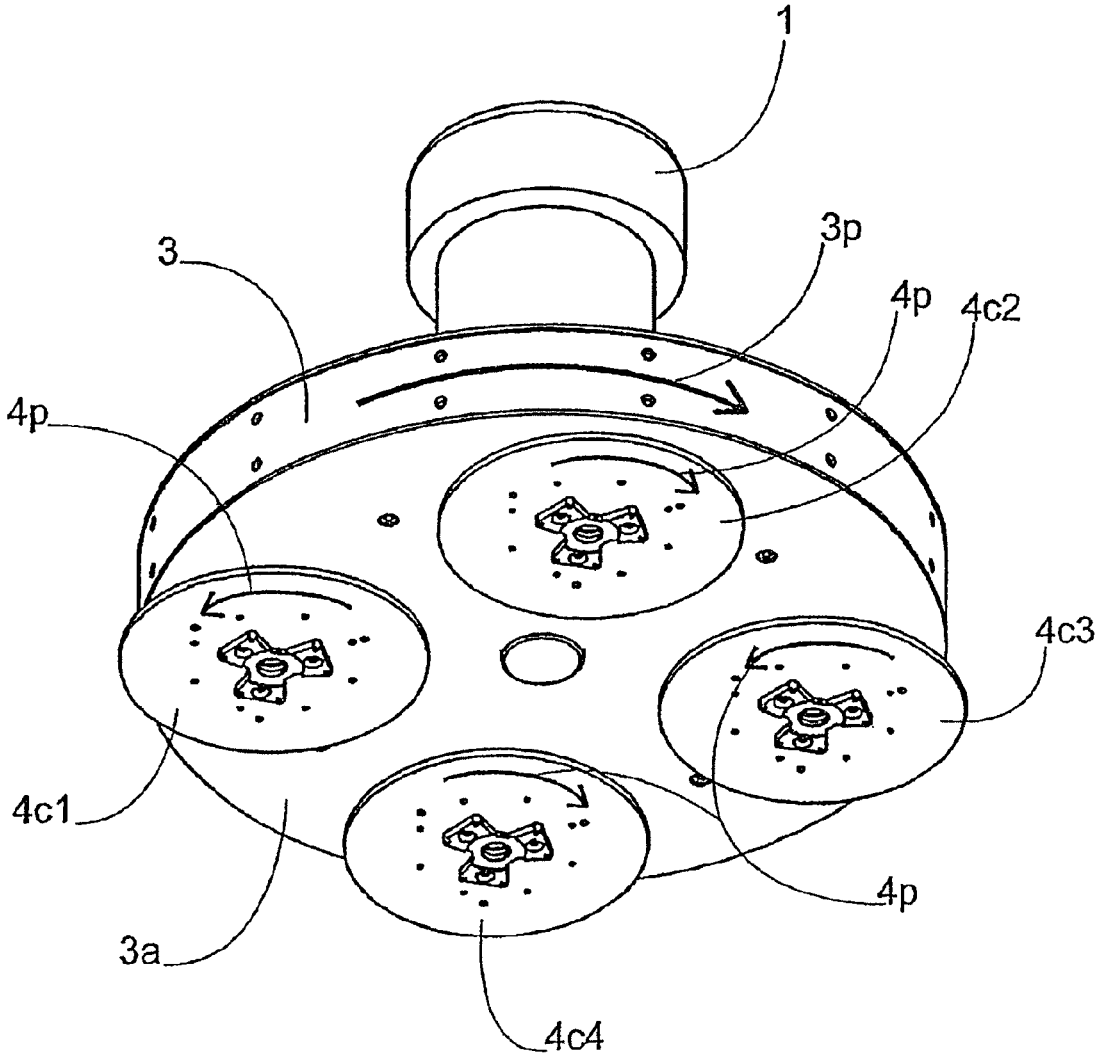

In FIGS. 1*a*, 1*b* and 1*c* numeral 1 denotes a drive motor mounted on a motor plate 2 of a screeding machine casing, not shown further, by means of a screw nut connection.

Inside the screeding machine casing there is a planet disk 3, which is supported so that it can rotate in relation to the motor plate of said housing. The planet disk 3 is shaped like a dish open at the bottom. When the screeding unit is ready for use the dish is covered by a protective plate 3*a* having openings for screeding disks 4*c*1-4*c*4. The dish with the protective plate 3*a* forms a protected space for the drive mechanism. The space accommodates four symmetrically located holders 4*a*1-4*a*4 for said screeding disks 4*c*1-4*c*4, the holders being supported so that they can rotate, in the planet disk 3. For the sake of clarity, the screeding disks have been omitted from FIG. 1*a* but are shown in FIG. 1*c*, in which the directions of rotation, according to the shown embodiment, of the screeding disks 4*c*1-4*c*4 and the planet disk 3 are also illustrated by arrows 3*p* and 4*p* respectively. A belt sheave 4*b*1-4*b*4 is connected to each holder 4*a*1-4*a*4 for driving each screeding disk in a known manner. A belt 6 runs over the belt sheaves 4*b*1-4*b*4 and over deflection sheaves 5 arranged between them. A belt sheave 1*a* arranged on the shaft of the motor 1 is designed to drive the belt sheave 4*b*2 by way of a belt 7, thereby causing the other belt sheaves to rotate. Since the belt 6 runs over that section of the circumference situated nearest to the centre of the planet disk 3 in respect of the belt sheaves 4*b*1 and 4*b*3 and over the section of the circumference situated furthest away from the said centre in respect of the belt sheaves 4*b*2 and 4*b*4, the belt sheaves 4*b* 1, 4*b*3 assume opposing directions of rotation relative to the belt sheaves 4*b*2, 4*b*4, thereby providing the characteristic feature of the adjacent screeding disks having opposite directions of rotation.

From FIG. 1*b* it can be seen that shafts of the belt sheaves 4*b* 1, 4*b*3 protrude from the dished planet disk 3 and form belt sheaves 8. A belt sheave 9 is fixed to the motor plate 2. A belt, by means of which the rotation of the motor 1 is transmitted to the planet disk 3 by way of the belt sheave 1*a*, the belt 7, the belt sheave 4*a*2, the belt 6 and the belt sheaves 4*b*1, 4*b*3, runs over the belt sheaves 8 and 9. It may be noted in this connection that the planet sheave 3 has the same direction of rotation as the screeding disks 4*c*2, 4*c*4.

The screeding device described above, known from the applicant's PCT-application WO02/062524, comprises what is called holders 4*c*1-4*c*4. These were developed especially for screeding machines and, as the market is rather small, they are not produced in very large numbers, which of course makes them quite expensive.

In order to lower the costs for all parties involved, the applicant began looking for alternative holders and finally found that automotive wheel hubs were the ideal solution. They turned out to be extremely durable and relatively cheap too.

Figure 2:
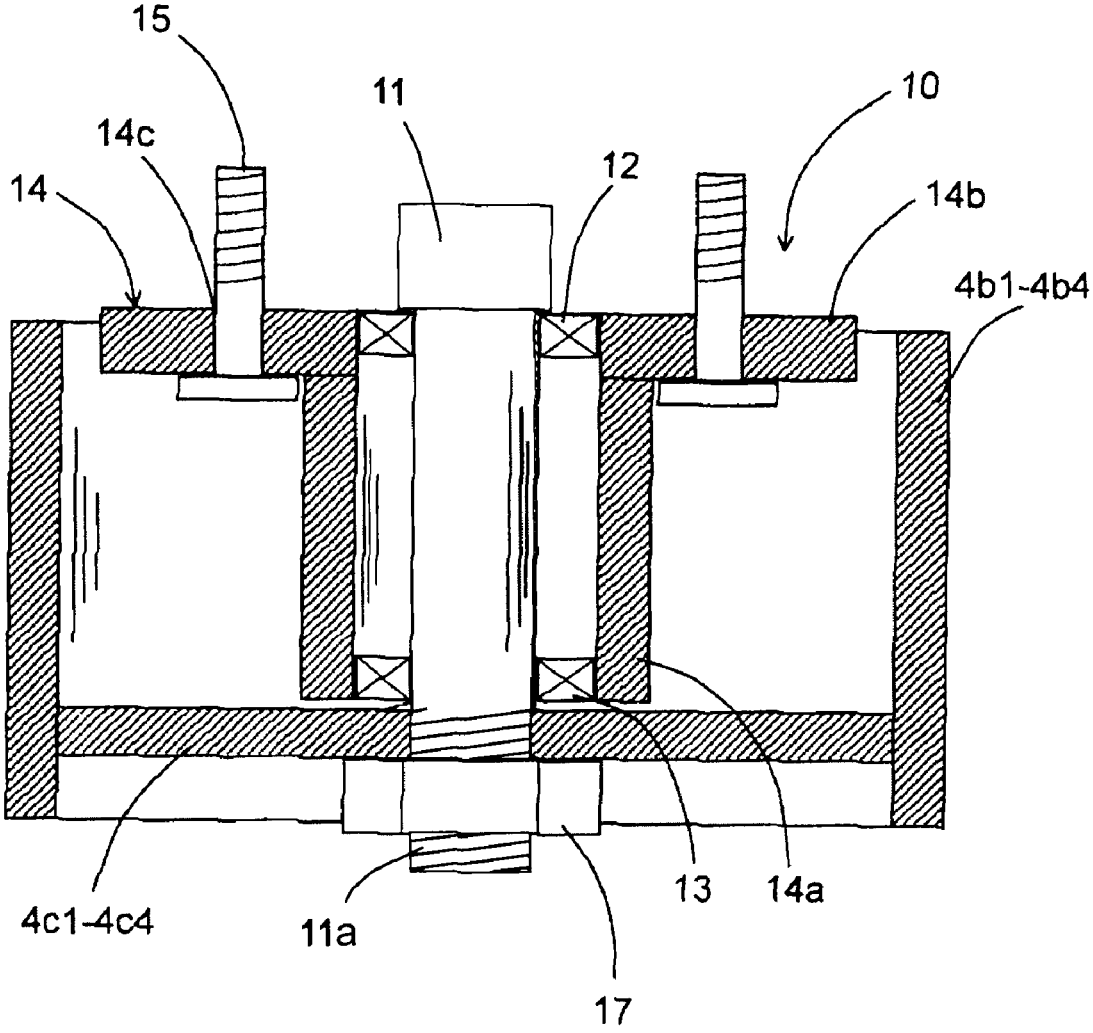

In FIG. 2 one such automotive wheel hub 10 is shown in a schematic sectional view. It comprises a central shaft 11, which is surrounded by two roller bearings 12, 13. These are mounted in a hollow central sleeve 14*a a* of a rim part 14, said rim part 14 further having a disk shaped flange 14*b* surrounding said sleeve 14*a*. The flange 14*b* has holes 14*c* for wheel bolts 15, which are closely fitting mounted within said holes 14*c* protruding on one of the flat sides of the flange 14*b*.

The skilled person realises that the schematically shown wheel hub 10 described this far is just like any ordinary or standard wheel hub on the market and that there are a few parts not shown, like sealings, which are not relevant for this disclosure.

A first difference to known automotive wheel hubs is that it is the central shaft 11 of the wheel hub 10 that forms the runner, i.e. the rotatable part, of the wheel hub 10. This is due to the wheel hub 10 being mounted on a planet disk 3 of a screeding machine by means of said wheel bolts 15 and the flange 14*b* therefore not being rotatable, but it does not affect the structure of a standard wheel hub as such.

A second difference is that the central shaft 11 is a stub axle having a section 11*a* furnished with threads. This is due to use thereof for mounting a screeding disk 4*c*1-4*c*4 of the kind described hereinbefore by screwing it on said shaft 11. In an alternative embodiment the shaft 11 is a bolt. Part of the shaft extends through said screeding disk 4*c*1-4*c*4 and a fastening device 17 is used to secure the screeding disk 4*c*1-4*c*4 to the shaft 11. In FIG. 2 there is shown a fastening device in the form of a nut 17 which is screwed onto the shaft 11. Other ways of fastening may for example include use of a cotter pin, or any other suitable type of fastening device known to the person skilled in the art. In an alternative embodiment, the shaft 11 is not a solid stub axle but a hollow sleeve. This is due to use thereof for mounting a screeding disk 4*c*1-4*c*4 of the kind described hereinbefore by means of a bolt 11 extending through said sleeve and a nut 17 screwed onto the bolt 11. Thus, the screeding disk 4*c*1-4*c*4 becomes rotatable vis-à-vis the planet disk 3 of the screeding machine. Even said second difference does not affect the structure of said standard wheel hub.

A third difference is that the wheel hub 10 is circumferentially surrounded not by a wheel but by a belt sheave 4*b*1-4*b*4 of a screeding machine. By surrounding the wheel hub 10 the belt sheave 4*b*1-4*b*4 effectively protects the roller bearings 12, 13 against dust produced while screeding, thereby prolonging life of the wheel hub 10. Neither the third difference affects the structure of said standard wheel hub. Thus, it is obvious that almost any standard automotive wheel hub is usable for the screeding machine according to the preferred embodiment of the invention.

Figure 3:
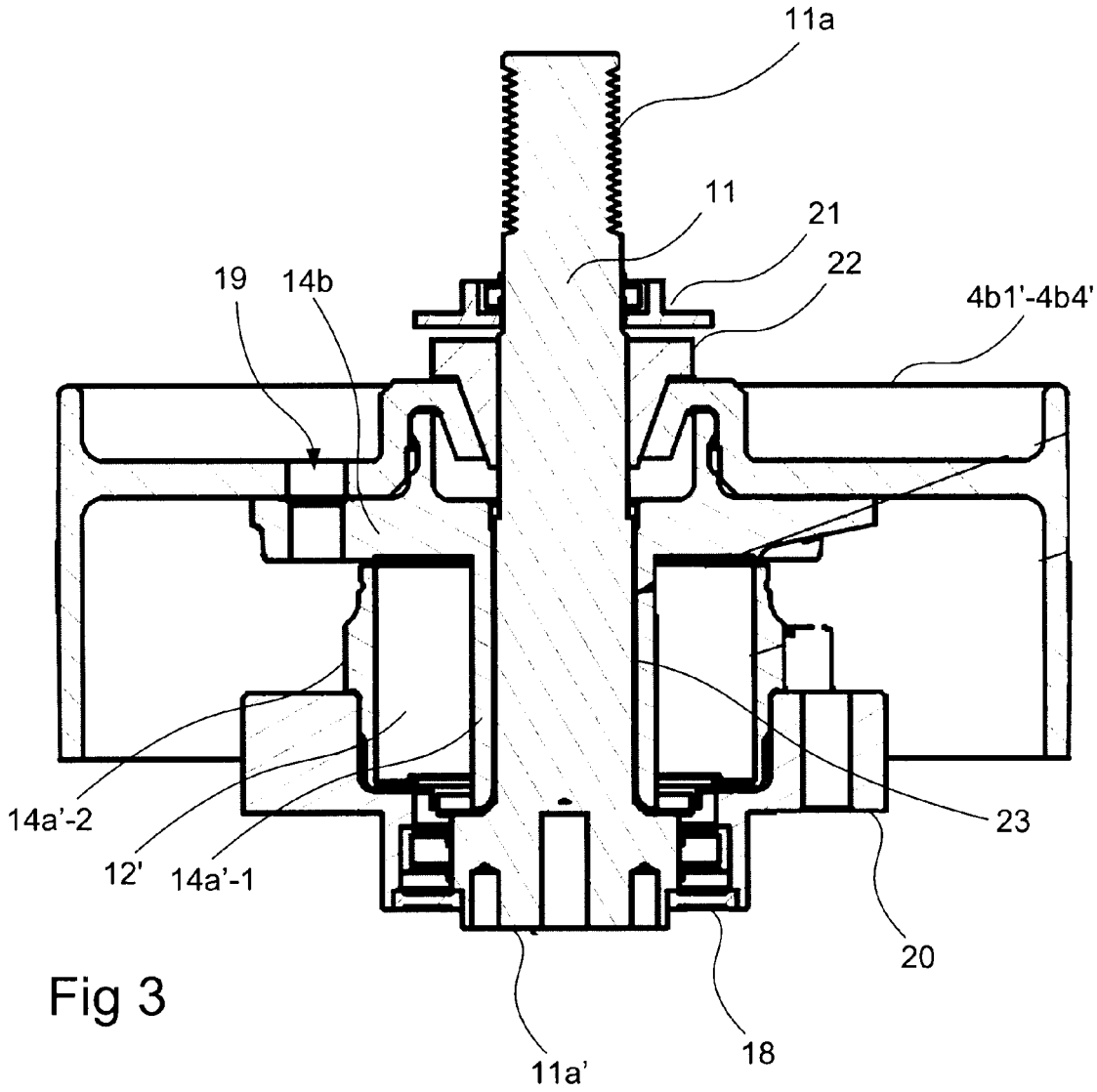
FIG. 3 schematically illustrates another embodiment of the present disclosure.

FIG. 3 illustrates another version of the inventive concept, where the automotive wheel hub unit has been turned upside-down relative to what was illustrated in FIG. 2. Hence, the flange 14*b* of the central sleeve 14*a*'-1 is connected by wheel bolts to the belt sheave 4*b*1'-4*b*4'. The central sleeve may be fixedly connected to the axle 11 in at least the circumferential direction, e.g. by splines 23. An outer sleeve 14*a*'-2 may be connected to the inner sleeve 14*a*'-1 by one or more, typically two, roller bearings. The outer sleeve may be fixedly connected to the planet disk. The central sleeve 14*a*'-1 and the outer sleeve 14*a*'-2 may provide a space 12' for the bearings, e.g. a pair of bearings as illustrated in FIG. 2.

An adapter ring 20 may be provided for connection of the automotive wheel hub unit to a lower plate of the planet disk 3. This adapter ring 20 may be fixedly connected to the outer sleeve 14*a*'-2, such that the central sleeve 14*a*'-1 rotates with the axle 11. The axle 11 may be sealed relative to the adapter ring 20 by a lower seal 18. The lowermost part of the axle 11 may provide a screeding disk attachment portion 11*a*', and the upper part of the axle 11 may provide a belt sheave or an attachment portion 11*a* for a belt sheave.

A locking ring 22 may be provided for centering the axle relative to the hub, and an upper seal 21 may be provided to seal against an upper plate of the planet disk.

Automobile wheel hub units of the type illustrated in FIG. 3 are normally used at drive wheels of a vehicle.

Although the invention above has been primarily illustrated and explained in connection with a screeding unit for a manually operated screeding machine, it is be obvious that the screeding machine according to the invention affords the same advantages when it is fitted to a powered screeding machine.

It is recognized that the belt may be any known belt, such as a frictionally engaging belt or a toothed belt, and the chain may be any suitable transmission chain.

It is further recognized that although the screeding machine is shown as having four screeding disks, the invention is applicable to any screeding machine having at least one screeding disk.

The invention claimed is:

1. A mobile machine for screeding floor surfaces, said machine comprising:

a planet disk, which is rotatably supported and driven by a drive motor, and which carries at least one screeding disk, operatively connected to the drive motor and defining one screeding plane, the operative connection comprising at least one belt or chain running over a belt sheave connected to the screeding disk, and a belt sheave connected to the drive motor, wherein a rotatable connection between the belt sheave of the screeding disk and the planet disk is provided by an automotive wheel hub, comprising a hollow central sleeve having a flange adapted to be engaged by wheel bolts and at least one roller bearing, and the belt sheave of the screeding disk protects the at least one roller bearing by circumferentially surrounding the automotive wheel hub.

2. A mobile machine according to claim 1, wherein the hollow central sleeve is connected by a bearing to a central stub axle, and by wheel bolts engaging the flange of the central sleeve is connected to the planet disk.

3. A mobile machine according to claim 2, the belt sheave of the screeding disk having a hub part, said stub axle extending through a central hole in said hub part and being secured to said hub part by a fastening device.

4. A mobile machine according to claim 2, the belt sheave of the screeding disk having a hub part, said stub axle being furnished with a section of threads for fastening it to said hub part.

5. A mobile machine according to claim 2, the belt sheave of the screeding disk having a hub part, said hub part abutting a rotatable runner of the wheel hub on a side opposite to the side of the wheel hub facing the planet disk, said stub axle being a bolt extending through a central hole in said hub part and through said runner and fixing the belt sheave onto said runner by means of a nut.

6. A mobile machine according to claim 1, the belt sheave of the screeding disk being cup shaped protectively surrounding the wheel hubs.

7. A mobile machine according to claim 1, wherein the belt or chain runs over least one deflection sheave.

8. A mobile machine according to claim 1, wherein the mobile machine comprises a number of screeding disks, each being operatively connected to the drive motor.

9. A mobile machine according to claim 1, wherein the flange is arranged at a rim portion of the central sleeve.

10. The mobile machine as claimed in claim 2, wherein the hollow central sleeve is connected to the central stub axle by a pair of roller bearings.

11. The mobile machine as claimed in claim 1, wherein the hollow central sleeve is connected to a central stub axle, and by wheel bolts engaging a flange of the central sleeve is connected to the belt sheave of the screeding disk.

12. A mobile machine according to claim 11, wherein the flange is arranged at a rim portion of the central sleeve.

13. A mobile machine according to claim 11, wherein an outer sleeve is fixedly connected to the planet disk, and connected to the central sleeve by at least one bearing.

14. The mobile machine as claimed in claim 13, wherein the central sleeve is connected to the outer sleeve by a pair of roller bearings.

15. A mobile machine according to claim 11, wherein an adapter ring is arranged to connect the outer sleeve to the planet disk

16. A mobile machine according to claim 11, wherein the central sleeve is fixedly connected to the stub axle in at least a rotational direction.

* * * * *